United States Patent [19]

Talalay et al.

[11] 4,271,639

[45] Jun. 9, 1981

[54] MANUFACTURE OF SPONGE RUBBER SPHERES

[76] Inventors: Anselm Talalay, 2867 Ludlow Rd., Cleveland, Ohio 44120; Leon Talalay, Chestnut La., Woodbridge, Conn. 06525

[21] Appl. No.: 11,288

[22] Filed: Feb. 12, 1979

[51] Int. Cl.[3] ..... B24B 1/00; B24B 11/08

[52] U.S. Cl. ..... 51/322; 264/15; 264/28; 264/162

[58] Field of Search ..... 51/322, 289 S; 62/320; 264/15, 28, 162; 409/131, 136, 140; 29/148.4 B; 15/3.31, 104.06; 83/15

[56] References Cited

U.S. PATENT DOCUMENTS

| | | | |
|---|---|---|---|
| 2,167,215 | 7/1939 | Leary | 62/320 X |
| 2,335,294 | 11/1943 | Meyer | 51/289 S |
| 2,801,824 | 8/1957 | Tarpogge | 15/3.51 X |
| 2,867,000 | 1/1959 | Huszar | 29/148.4 B |
| 3,112,851 | 12/1963 | Collins | 83/15 |
| 3,640,028 | 2/1972 | Richard | 51/289 S |
| 3,812,224 | 5/1974 | Smith | 264/28 |
| 3,874,124 | 4/1975 | Morgan | 51/322 X |
| 4,021,280 | 5/1977 | Rinde | 264/28 X |

*Primary Examiner*—Gary L. Smith
*Attorney, Agent, or Firm*—Harold S. Meyer

[57] ABSTRACT

This disclosure relates to the manufacture of sponge rubber spheres, such as spheres (10) used for cleaning tubes internally, and the shapes made thereby. The sponge rubber is initially cut into cubes approximating the shape of the final product. Next the sponge rubber is frozen by means of liquid nitrogen. Then while in the frozen state it is machined to the final shape. This machining could be performed by a centerless grinding technique involving a grinding wheel (41), a regulating wheel (42), and a work rest (43). Additionally, a plurality of shapes may be formed at one time from a single block of sponge rubber (30) as shown in FIG. 2.

7 Claims, 5 Drawing Figures

MANUFACTURE OF SPONGE RUBBER SPHERES

BACKGROUND

This invention relates to the manufacture of cellular rubber products, with either open or closed pores, but preferably products made from open pore sponge rubber or foam rubber.

More particularly the invention relates to manufacture of spherical sponges, which are circulated through the tubes of heat exchangers to clean the inner surfaces of the tubes, as described in Taprogge U.S. Pat. No. 2,801,824, particularly Column 4, lines 7 to 27.

Cellular rubber such as ordinary rubber sponge tends to have a skin, and when the sponges are to be used for cleaning, they must be trimmed to remove the skin and expose the cut edges of the rubber partitions which enclose the pores, since it is the edges which are effective in scrubbing fouled surfaces. Consequently, sponges are ordinarily made oversize and trimmed to the desired size and shape.

Trimming of rubber sponges having a doubly curved surface has been a slow and expensive procedure, since the rubber sponge is flimsy and difficult to support adequately while it is being trimmed to the desired size and shape, particularly if the sponge product is about an inch (25 mm) or less in over-all size.

SUMMARY OF THE INVENTION

In this invention, the rubber sponge, in its original manufactured size and shape, or cut to a reduced size somewhat larger than the desired finished article, is frozen, by cooling to its glass-transition-temperature, at which its consistency is similar to that of glass, and then, while frozen, is trimmed to the exact size and shape in which it is to be used, preferably by a high speed material-removing tool, such as a rotary wood-planing cutter, or preferably an abrasive grinding wheel.

The sponge, which is to be trimmed to a particular shape, can be made from any material which is more or less elastomeric such as natural rubber or its synthetic duplicate, or the somewhat similar diene polymer synthetic rubbers such as poly-butadiene or butadiene-styrene rubber or butadiene-acrylonitrile rubber, or elastomers of many other kinds such as neoprene or silicone rubber.

The procedure for making the sponge can be any of the known processes which lead to a product having adequate porosity and thin flexible walls between the pores. In particular, the sponge material can be either chemically blown sponge with open pores, made by vulcanizing a rubber mix containing gas releasing chemicals to produce the pores; or can be latex foam, made by foaming liquid latex then gelling, vulcanizing, and drying the foam; or can even be closed-cell "expanded rubber" made by dissolving a gas in the rubber under high pressure and releasing the pressure when the rubber is at least partly vulcanized.

In accordance with this invention, the rubber sponge material, in a size somewhat larger than that of the desired product, is frozen by cooling to below its glass-transition temperature, which is a temperature at which it is quite hard, like wood, and is then trimmed to the desired size and shape, preferably by a high speed rotary material-removing cutter such as a wood-planing-mill cutter, or better by a grinding wheel.

The freezing of the sponge material, to prepare it for final trimming to the desired size and shape, should be at a temperature sufficiently low to make the rubber material so rigid that it will resist displacement by the pressure of the cutting tool and therefore will be trimmed to an accurate size and shape.

The freezing is most conveniently accomplished by use of a very cold gas resulting from evaporation of a liquid or solid having an extremely low vaporization temperature. With some elastomers, liquid or solid carbon dioxide, producing temperatures of about −50° to −75° C., is adequate, but it is generally preferred to use the much lower temperature of about −195° C. produced by liquid nitrogen, which is conveniently available at moderate cost, and permits trimming of essentially all elastomers to closely controlled dimensions.

THE DRAWINGS

SPECIFIC DESCRIPTION

Figure 1:
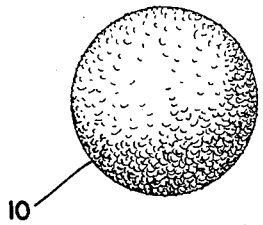
FIG. 1 shows a sponge ball made by the process of this invention.

In a presently preferred embodiment of the invention, a sphere 10 of sponge rubber, as shown in FIG. 1, is prepared by mixing natural rubber or its synthetic equivalent with conventional vulcanizing and blowing agents suitable for production of a sponge having an apparent density of about 0.2, and which is not significantly affected by continuous immersion in water, and then vulcanizing the mix in a slab mold of about one inch (25 mm) thickness.

The vulcanized sponge slab is cut into cubes, which may be roughly rounded by cutting off the edges and corners, and which are then frozen. This may be accomplished in any convenient manner, such as by placement of the sponge cubes in a well insulated container within which are a pan filled with liquid nitrogen, and a circulating fan, thus exposing the sponge rubber cube to a circulating atmosphere of very cold nitrogen gas. Direct immersion of a cellular body into liquid nitrogen has been found to be wasteful.

Figure 4:
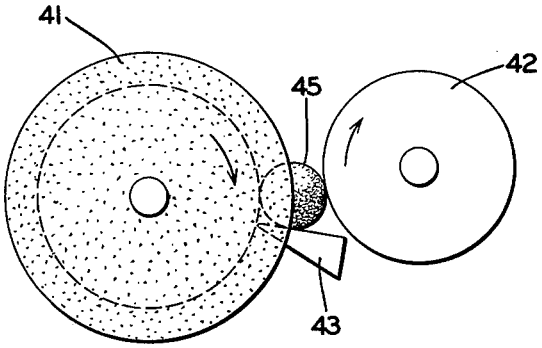
FIG. 4 is a diagrammatic representation of a sponge ball being shaped in a centerless grinder.
Figure 5:
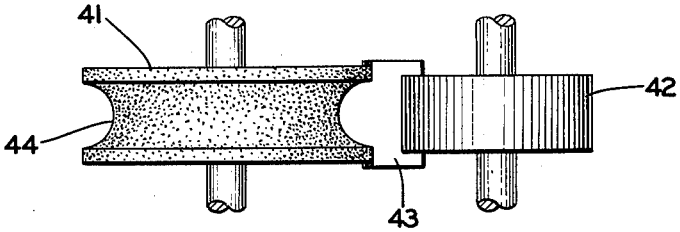
FIG. 5 is a plan view of the centerless grinder of FIG. 4.

The frozen pieces of sponge are shaped in a centerless grinder, shown diagrammatically in FIGS. 4 and 5, comprising a work wheel 41 with a face of the shape corresponding to the surface of the revolution of the desired product. This is preferably an ordinary abrasive grinding wheel.

Since the product in this case is a sphere, the grinding surface consists of semi-circular groove 44 around the periphery of the wheel, for forming the sphere 10. The grinder also conventionally includes a regulating wheel 42 and a work rest 43 on which the work piece 45 is supported while it is being shaped to form sphere 10.

In accordance with a preferred procedure, the frozen oversize pieces of sponge rubber can be fed one after another to the working position on the work rest 43 of a conventional automatically fed centerless grinder, where each will be quickly and precisely ground to the desired size with an accurately spherical surface and will then be discharged and replaced by another piece of sponge rubber, which will be similarly ground. The spherically shaped rubber sponge products will be discharged into a location where they can warm up to room temperature and regain their rubber-like resiliency. If desired, the finished pieces can then be washed to remove any particles of ground rubber before being put to use or packed for shipment.

It has long been known that solid rubber, when cooled to the extremely low temperatures employed in this invention, becomes brittle and shatters when subjected to stress. This would have appeared to be especially the case with sponge rubber in which the thickness of rubber is small so that even minor force would have appeared to be sufficient to shatter the frozen rubber and make it useless.

Surprisingly, it was found that exactly the opposite effect actually occurs and that the thinness of the cell walls of cellular or sponge rubber permits the material to absorb the cutting forces exerted by the grinding wheel without shattering so that precise and extremely rapid removal of material is accomplished to produce an accurately shaped and dimensioned product.

It is common knowledge that grinding produces a great deal of heat. It could therefore be supposed that the heat so generated would quickly warm the work piece and make it again flexible. Again, surprisingly, it was found that such effect does not occur, and that a frozen block of sponge rubber can be ground precisely and very quickly to its desired shape without supply of additional refrigeration during the grinding operation.

Because of the accurate dimensions which are easily and automatically attainable, and the regular surfaces which result from the high speed machining of the very cold, freeze-hardened material, it has been found that production of accurately spherical and uniformly dimensioned sponge rubber balls can be accomplished very rapidly and very economically.

Although an important use of this invention is in the production of uniformly sized sponge rubber spheres for use in cleaning the inner surfaces of heat exchange tubes, the invention is not limited to production of spheres but can be used for production of other kinds of precisely shaped sponge rubber products by freezing the sponge rubber work piece to a very low temperature and employing a suitable high speed material-removing cutter such as an abrasive grinding wheel or a single-point cutter of the kind generally used for shaping solid materials.

It is even possible to shape a plurality of articles at once by cutting a slab of sponge rubber into strips large enough to permit simultaneous shaping of two or more articles.

Figure 2:
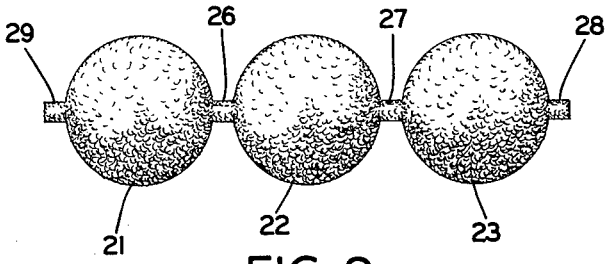
FIG. 2 shows three sponge balls made simultaneously.
Figure 3:
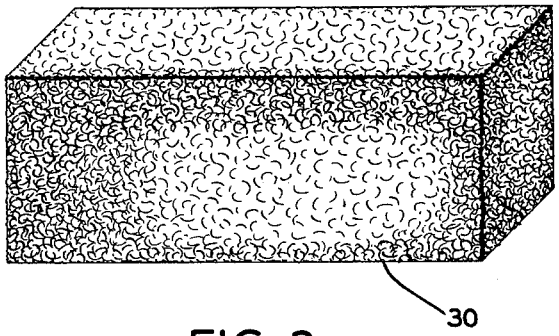
FIG. 3 shows a sponge block from which the balls of FIG. 2 can be made.

Thus, as shown in FIG. 3 and FIG. 2, a slab of sponge rubber can be cut into a rectangular strip of suitable size for production of two or more objects.

By using a gang cutter, and preferably a grinding wheel with three semi-circular grooves in a centerless grinder, the sponge rubber rectangular bar 30 can be frozen and then very quickly converted into the condition shown in FIG. 2, in which the group of spheres 21, 22, 23 are still connected by tiny necks 26, 27 and with another neck 28, 29 at either end. These remaining necks 26, 27, 28, 29 can simply be snipped off, and a group of three essentially perfect spheres is produced in a single operation.

We claim:

1. A process for shaping a rubber sponge article having its pores filled with gas, which process comprises freezing rubber sponge by cooling it below its glass transition temperature by contact with very cold gas, and removing excess rubber sponge material from the frozen rubber sponge by high speed machining.

2. A process as in claim 1 in which the rubber sponge is frozen by means of cold gas evolved from evaporation of liquid nitrogen.

3. A process as in claim 1 in which the material is removed by centerless grinding.

4. A process as in claim 2 in which the material is removed by centerless grinding with a grooved grinding wheel to produce a sphere.

5. A process as in claim 2 in which the material is removed by centerless grinding of an elongated blank to produce a sequence of connected spheres, and the spheres are severed.

6. A process as in claim 2 in which the material is removed by centerless grinding.

7. A process as in claim 3 in which the rubber sponge is made from latex foam.

* * * * *